US008192269B2

(12) United States Patent
Yacenda

(10) Patent No.: US 8,192,269 B2
(45) Date of Patent: Jun. 5, 2012

(54) SYSTEM AND METHOD FOR OPERATING ON-LINE GOVERNMENTAL LOTTERY GAMES

(75) Inventor: Michael W. Yacenda, Stamford, CT (US)

(73) Assignee: Elottery, Inc., Stamford, CT (US)

( * ) Notice: Subject to any disclaimer, the term of this patent is extended or adjusted under 35 U.S.C. 154(b) by 944 days.

(21) Appl. No.: 12/192,820

(22) Filed: Aug. 15, 2008

(65) Prior Publication Data

US 2009/0042633 A1 Feb. 12, 2009

Related U.S. Application Data

(63) Continuation-in-part of application No. 11/546,945, filed on Oct. 12, 2006, now Pat. No. 7,946,913, which is a continuation-in-part of application No. 11/071,607, filed on Mar. 3, 2005, now Pat. No. 7,931,529, which is a continuation of application No. 10/000,795, filed on Nov. 2, 2001, now Pat. No. 6,869,358, which is a continuation-in-part of application No. 09/458,326, filed on Dec. 10, 1999, now Pat. No. 6,322,446.

(51) Int. Cl.
*A63F 3/06* (2006.01)

(52) U.S. Cl. ..... 463/17; 463/41; 463/42

(58) Field of Classification Search ..... 463/17, 463/41, 42

See application file for complete search history.

(56) References Cited

U.S. PATENT DOCUMENTS

| | | | |
|---|---|---|---|
| 4,713,837 | A | 12/1987 | Gordon |
| 4,815,741 | A | 3/1989 | Small |
| 4,842,278 | A | 6/1989 | Markowicz |
| 4,922,522 | A | 5/1990 | Scanlon |
| 5,083,272 | A | 1/1992 | Walker et al. |
| 5,326,104 | A | 7/1994 | Pease et al. |
| 5,646,839 | A | 7/1997 | Katz |
| 5,954,582 | A | 9/1999 | Zach |
| 5,979,894 | A | 11/1999 | Alexoff |
| 6,017,032 | A | 1/2000 | Grippo et al. |
| 6,024,641 | A | 2/2000 | Sarno |
| 6,069,890 | A | 5/2000 | White et al. |
| 6,080,062 | A | 6/2000 | Olson |
| 6,086,477 | A | 7/2000 | Walker et al. |

(Continued)

FOREIGN PATENT DOCUMENTS

WO WO 95-10098 4/1995

(Continued)

OTHER PUBLICATIONS

International Search Report dated Sep. 22, 2009.

(Continued)

*Primary Examiner* — Peter DungBa Vo
*Assistant Examiner* — Damon Pierce
(74) *Attorney, Agent, or Firm* — F. Chau & Associates, LLC

(57) ABSTRACT

A method for facilitating governmental lottery play over an electronic network includes receiving a request for mobile player terminal location information from an agent server, acquiring location information based upon distances between the mobile player terminal and a plurality of transmitters with known locations, transmitting the acquired location information to the agent server, determining whether the mobile player terminal is located within a lottery jurisdiction based on the transmitted location information, and processing the purchase of a lottery ticket when the location of the mobile player terminal is determined to be located within the lottery jurisdiction.

7 Claims, 7 Drawing Sheets

U.S. PATENT DOCUMENTS

| | | | |
|---|---|---|---|
| 6,102,400 | A | 8/2000 | Scott et al. |
| 6,146,272 | A | 11/2000 | Walker et al. |
| 6,154,172 | A | 11/2000 | Piccionelli et al. |
| 6,168,521 | B1 | 1/2001 | Luciano et al. |
| 6,183,361 | B1 | 2/2001 | Cummings et al. |
| 6,251,016 | B1 | 6/2001 | Tsuda et al. |
| 6,277,026 | B1 | 8/2001 | Archer |
| 6,383,078 | B1 | 5/2002 | Yacenda |
| 6,599,186 | B1 | 7/2003 | Walker et al. |
| 6,874,783 | B2 | 4/2005 | Higginson |
| 2001/0003100 | A1 | 6/2001 | Yacenda |
| 2001/0031661 | A1 | 10/2001 | Wiltshire et al. |
| 2002/0147049 | A1 | 10/2002 | Carter, Sr. |
| 2002/0174444 | A1 | 11/2002 | Gatto et al. |
| 2004/0060064 | A1 | 3/2004 | Poli |
| 2004/0259626 | A1 | 12/2004 | Akram et al. |
| 2005/0153779 | A1 | 7/2005 | Ziegler |
| 2005/0215306 | A1 | 9/2005 | O'Donnell et al. |
| 2006/0035697 | A1* | 2/2006 | Packes et al. ..... 463/17 |
| 2007/0060284 | A1 | 3/2007 | Yacenda |
| 2008/0015013 | A1* | 1/2008 | Gelman et al. ..... 463/25 |

FOREIGN PATENT DOCUMENTS

| | | |
|---|---|---|
| WO | WO 01/18759 | 3/2001 |
| WO | WO 01/70359 | 9/2001 |
| WO | WO 01/71677 | 9/2001 |

OTHER PUBLICATIONS

Statement of Grounds and Particulars in Support of Opposition dated Oct. 2, 2009 by South Wales Lotteries Corporation.

Statement of Grounds and Particulars in Support of Opposition dated Sep. 25, 2009 by Manaccom Corporation Ltd.

US 5,823,877, 10/1998, Scagnelli et al. (withdrawn)

* cited by examiner

FIG. 5

In-state Verification Test

We must verify that you are within the state of Colorado. Please follow the instructions below:

1. Enter the number, including area code, of an available land-based telephone where you are currently located:
   303
2. Click the button below to request a verification call from our automated operator (your phone will ring within 30 seconds).

Verify Location
3. Answer your verification call and, when prompted, provide the last four digits of your credit card number (6478).

If you are not in Colorado, or do not have access to a land-based telephone. Please cancel this transaction and try again later.

Cancel Order

SYSTEM AND METHOD FOR OPERATING ON-LINE GOVERNMENTAL LOTTERY GAMES

RELATED APPLICATION DATA

The present application is a continuation-in-part of commonly assigned application Ser. No. 11/546,945, filed Oct. 12, 2006 now U.S. Pat. No. 7,946,913, which is a continuation-in-part of commonly assigned application Ser. No. 11/071,607, filed Mar. 3, 2005 now U.S. Pat. No. 7,931,529, which is a continuation of commonly assigned application Ser. No. 10/000,795, filed Nov. 2, 2001, now U.S. Pat. No. 6,869,358, issued Mar. 22, 2005, which is a continuation-in-part of commonly assigned application Ser. No. 09/458,326, filed on Dec. 10, 1999, now U.S. Pat. No. 6,322,446, issued Nov. 27, 2001.

BACKGROUND OF THE INVENTION

1. Technical Field

The present invention relates to a system and a method for playing lottery games via an electronic network, and more particularly to a system and a method for operating or facilitating on-line state lottery games.

2. Discussion of the Related Art

In traditional lottery games, lottery players walk into convenience retailers, manually fill out selection slips, and exchange cash or credit with a clerk, who then enters the selections into a lottery terminal. This lottery terminal electronically connects to a central lottery system which manages the lottery games. The central game system then issues a coded lottery ticket, and the lottery ticket is delivered to the lottery players through the local lottery terminal at the retailer. To play lottery games administered by governmental entities such as countries, states, provinces or multi-state lottery associations, lottery players are required to travel to retailers and sometimes wait in line to purchase lottery tickets.

Numerous interactive games on the Internet are now available. These include both games of skill or games of chance (wager) such as virtual casinos. However, lottery games such as lotteries offered by the governmental entities have not been made available on the Internet. One reason may be concern regarding security and fraud as to forged winning tickets. Also, it may be more difficult to verify play criteria such as the age or residence of the lottery players. If governmental entities' lottery tickets can be purchased by players over publicly accessible electronic or telephonic network such as the Internet, it can be anticipated that many more players will participate in the lottery. Many more tickets will be sold and awards will be much larger. If online lottery play of a governmental lottery is possible, other features such as subscription play wherein players subscribe to a periodic play of same numbers can be added, thereby making lottery gaming even more attractive.

Therefore, a need exists for a lottery agent system which facilitates lottery play of governmental lotteries via an electronic network such as through the Internet. A need also exists for a lottery agent system which makes available through the electronic network the purchase of governmental lottery tickets and facilitates additional features such as subscription play and instant play.

The U.S. Wire Act restricts the purchase of lottery tickets over the Internet without knowingly accepting information assisting in the placing of bets or wagers from persons located outside the state at the time of purchase. Pending U.S. legislation proposes rules to permit intrastate Internet wagering provided state regulations include reasonably designed verification of age and location to prevent access to minors and persons located outside the state and appropriate data security standards to prevent access by unverified persons whose age and current location do not satisfy state laws or regulations.

Existing geolocation technology relates an IP Address to a geographic location. However, since IP addresses are registered to a country, geolocation technology can determine a country, but state-level accuracy is limited. Proprietary databases claim to determine a more precise geography at a city or regional level. Geolocation limitations prevent absolute assurance of in state location.

Accordingly, geolocation technology has insufficient accuracy and is prone to circumvention. For example, self-proclaimed market leader, Quova, publicizes an accuracy of only 94%. Geolocation software can be circumvented easily where a player can access the Internet from any state by using an Internet access dial-in number in the desired state. For example, the Internet service provider AOL maintains a large set of dial-in numbers all across the United States. AOL routes their Internet traffic in a complex manner that confounds geolocation software. Accordingly, conventional geolocation techniques cannot determine the state from which an AOL user originates.

Moreover, Internet users may utilize proxy server to mask their location. A proxy server is a server that acts as an intermediary between the user and the desired website. Because the proxy server handles communication with the desired website, it may appear to the website that the user is actually located at the site of the proxy server. By selecting an appropriately located proxy server, a user may make him or herself appear to be in any desired location, thus confounding geolocation techniques.

Moreover, it is becoming increasingly common for users to access the Internet from a wide variety of mobile electronic devises such as laptop computers, cellular telephones/smartphones, PDAs and other mobile devices. These mobile devices may connect to the Internet in a wide variety of ways, including WiFi connections, WiMax connections, and cellular connections such as over an EVDO network such as those provided by Sprint Nextel Corporation and Verizon Wireless or over a GPRS/UMTS network such as those provided by AT&T Mobility or T-Mobile.

Conventional geolocation techniques may be partially or entirely useless when trying to identify the location of a user who is accessing the Internet wirelessly through one or more of these or other mobile solutions.

SUMMARY OF THE INVENTION

A method for facilitating governmental lottery play over an electronic network includes receiving a request for mobile player terminal location information from an agent server, acquiring location information based upon distances between the mobile player terminal and a plurality of transmitters with known locations, transmitting the acquired location information to the agent server, determining whether the mobile player terminal is located within a lottery jurisdiction based on the transmitted location information, and processing the purchase of a lottery ticket when the location of the mobile player terminal is determined to be located within the lottery jurisdiction.

The mobile player terminal may include a cellular telephone with a wireless connection to the Internet. The cellular telephone may be a smartphone. The mobile player terminal may include a portable computer with a wireless connection to the Internet. The wireless connection to the Internet may include a cellular telephone network radio, a WiFi adapter, or a WiMax adapter. The location information may be acquired using GPS. Location information may be acquired using cellular telephone localization. Determining whether the mobile player terminal is located within a lottery jurisdiction based on the transmitted location information may include analyzing latitude and longitude coordinates of the location information to determine whether the coordinates are within the boundaries of the lottery jurisdiction. The purchase of the lottery ticket may be prevented when the location of the mobile player terminal is determined to be located beyond the lottery jurisdiction. The acquired location information may be encrypted, digitally signed, or digitally watermarked prior to being transmitted to the agent server.

A system for facilitating governmental lottery play over an electronic network includes an agent server connected via the electronic network for receiving player and ticket information transmitted from a mobile player terminal, for transmitting the ticket information to a governmental lottery administrator, and for receiving a serial number issued by the governmental lottery administrator in association with a lottery ticket, a database in the agent server for storing the player and ticket information and the serial number associated with the lottery ticket, and a screening unit in the agent server, having player geographic location criteria by the governmental lottery administrator pre-stored therein, for verifying that a player satisfies the geographic location criteria prior to transmitting the ticket information to the governmental lottery administrator. The screening unit receives location information based upon distances between the mobile player terminal and a plurality of transmitters with known locations and determines whether the mobile player terminal satisfies the geographic location criteria based on the transmitted location information.

The mobile player terminal may include a cellular telephone with a wireless connection to the Internet. The cellular telephone may be a smartphone. The mobile player terminal may include a portable computer with a wireless connection to the Internet. The wireless connection to the Internet may include a cellular telephone network radio, a WiFi adapter, or a WiMax adapter. The location information may be acquired using GPS. The location information may be acquired using cellular telephone localization.

A system for facilitating governmental lottery play over an electronic network includes a mobile player terminal including a location unit for automatically determining a present location, and a radio for connecting wirelessly to the Internet, and a lottery agent server including a connection to the Internet across which the lottery agent server receives information pertaining to the determined present location of the mobile player terminal, a processing unit for determining whether the present location of the mobile player terminal is within a lottery jurisdiction, and an electronic lottery ticket processing unit for facilitating the purchase of a lottery ticket by a user over the mobile player terminal when it is determined that the present location of the mobile player terminal is within the lottery jurisdiction.

The location unit may include a GPS receiver, a cellular localization unit, or a WiFi localization unit. The mobile player terminal may include an encryption device for encrypting and digitally signing the information pertaining to the determined present location of the mobile player terminal.

BRIEF DESCRIPTION OF THE DRAWINGS

This disclosure will present in detail the following description of preferred embodiments with reference to the following figures wherein:

FIG. 5 illustrates a geographic location verification web page according to an exemplary embodiment of the present invention.

DETAILED DESCRIPTION OF EXEMPLARY EMBODIMENTS

Figure 1:
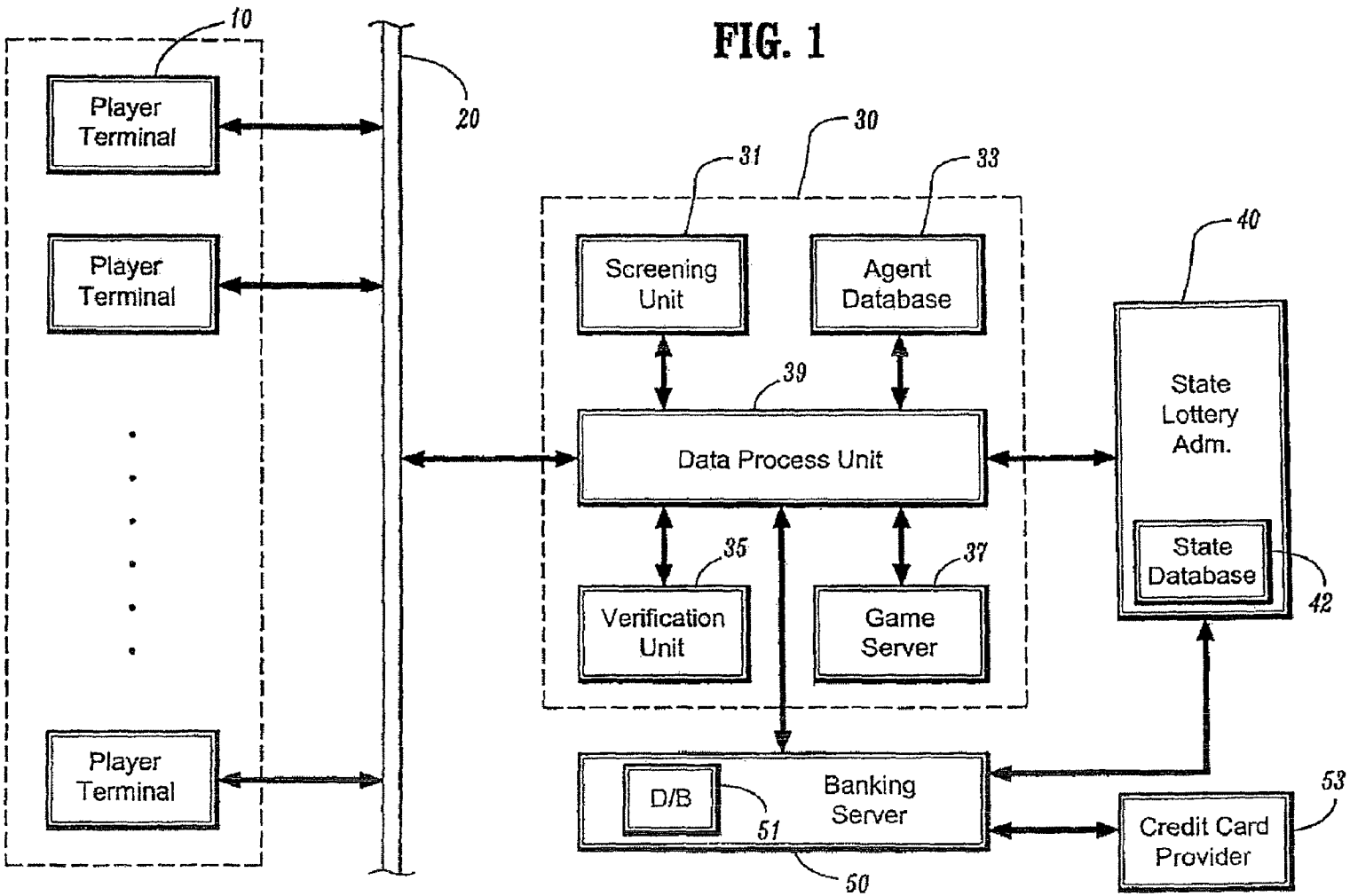
FIG. 1 is a block diagram illustrating a preferred embodiment of a lottery agent system according to the present invention.

The present disclosure describes a lottery agent system for facilitating lottery games which makes it possible to purchase lottery tickets and to play lottery games at player terminals through a communication network. The lottery agent system of the present invention more particularly relates to playing lottery games provided by a governmental entity such as a country, county, state, province or multi-state lottery association (hereafter referred to as "state"). The system includes an agent server for interacting with lottery players and lottery administrators of the states to manage and facilitate the state lottery games. For example, lottery players access the agent server via an electronic network such as the Internet to purchase lottery tickets at the player terminals, such as personal computers or lottery terminals, for playing lottery games. The lottery players enter player information, such as names, addresses, ages, and accounts of the lottery players, and ticket information of the lottery tickets to be purchased. The types of games include the traditional periodic games (which draw winning numbers twice a week, weekly or monthly etc.), instant games wherein players learn whether they have won nearly instantaneously, or subscription games. The players purchase lottery on a subscription basis by entering subscription play information such as the lottery numbers, the amount of wager, and the duration or number of plays using the lottery numbers. The accounts may be credit card accounts or bank accounts of the lottery players, or separate accounts or other payment method such as prepaid account cards established by the agent server for the lottery players for the use of lottery games. Upon receiving the player and ticket information, the agent server verifies based on the player information of the lottery players that each lottery player satisfies certain criteria required by the state.

After such verification of the lottery players, the agent server sends the ticket information via the Internet to each state lottery administrator which then provides the agent server with security or serial numbers associated with each lottery ticket purchased. The security or serial numbers (hereinafter referred to as "serial numbers") are preferably encrypted numbers. Each ticket sold is assigned a unique serial number by the state. In the case of instant lottery games, the instant tickets and associated serial numbers are pre-stored in a database at the agent server. The agent server transmits lottery game data to the player terminals of the lottery players upon confirmation of the purchase of the lottery tickets.

Upon drawing winning numbers, the agent server verifies winning tickets of which ticket numbers match the winning numbers, based on the serial numbers received from the state lottery administrator. The agent server then notifies the lottery players of the verified winning tickets.

The agent server also transmits to the state lottery administrator the ticket information of the winning tickets including the serial numbers associated with the winning tickets. The state lottery administrator verifies the ticket information received from the agent server with the ticket information previously stored in a state database. Upon a successful verification, the state lottery administrator issues claim validation numbers associated with the verified winning tickets for the future claims on lottery awards by winning players. The claim validation numbers issued by the state lottery administrator are stored in the state database and transmitted to the agent server.

The lottery agent system may also include a banking server which interacts with the agent server and the each state lottery administrator and credits an account of each winning player with a winning amount provided by the each state administrator and debits the account for purchase of the lottery tickets.

Thus, a lottery agent system of the present invention performs a screening and a verification process. Preferably, upon receiving the player and ticket information, the agent server screens each lottery player for satisfaction of criteria set by the states. Upon purchase of a ticket, the serial number associated with each ticket is stored. Upon a drawing of winning numbers, the agent server verifies winning tickets with the player's information, serial numbers and validation numbers issued by each state administrator and stored in a database of the agent server.

FIG. 1 shows a preferred embodiment of a lottery agent system according to the present invention. Player terminals 10 are used by lottery players to enter information for playing lottery games. The player terminals 10 may be personal computers of the lottery players and/or lottery terminals specifically for playing lottery games and located at readily accessible places. To purchase lottery tickets, the lottery players enter at the player terminals 10 player information, such as age and address, account number of the player, and ticket information, such as types and numbers of lottery tickets to be purchased, including specifying instant play or subscription play as a subscriber. The player and ticket information is transferred via a communication network 20 to an agent server 30. The communication network 20 is preferably a global electronic network such as the Internet through which a lottery website is provided for the lottery players to log on.

The agent server 30 includes a plurality of program modules having stored codes executable by a data process unit 39 for effecting agent server functions including communicating over the electronic network. Other modules include a screening unit 31 for verifying based on the player information that each lottery player satisfies certain criteria required for playing lottery games, an agent database 33 for storing the player and ticket information and serial numbers generated by a state lottery administrator 40, a verification unit 35 for verifying winning tickets based on the ticket information and the serial numbers after a drawing of winning numbers, a game server 37 for storing and providing various types of lottery games. The data process unit 39 also communicates control and data signals with the above and other components of the agent server 30. The game server 37 includes a subscription play unit (not shown) for monitoring subscription play and putting in play the subscription lottery numbers for a pre-specified number of draws until expiration of the specified subscription time period. Detail description of the agent server 30 in FIG. 1 follows.

When a lottery player enters his/her player and ticket information at a player terminal 10 to purchase lottery tickets, the screening unit 31 receives the player and ticket information and verifies based on the player information that the lottery player satisfies certain criteria required by the state. The criteria, for example, minimum age and residency within the border of the state, are set by the state as a condition to purchase lottery tickets. Such criteria may be previously stored in the screen unit 31. For the verification, the screening unit 31 compares the criteria with the player information to confirm that each and every requirement of the criteria is satisfied with each corresponding data of the player information. For example, the screen unit 31 may perform comparison and determination with respect to whether the lottery player's age is over the minimum age, whether the lottery player's address falls within the border of the state, and so on. If the player information is successfully verified by the screening unit 31, the verified player information along with the ticket information is stored in the agent database 33 under the control of the data process unit 39. Upon such verification, the ticket information is transmitted to the state lottery administrator 40 under the control of the data process unit 39. Upon receiving and storing the ticket information in a state database 42, the state lottery administrator 40 issues serial numbers associated with the lottery tickets to be purchased in accordance with the ticket information. Each of the serial numbers is associated with each of the lottery tickets to be purchased. That is, each serial number is unique to each lottery ticket to be purchased. The serial numbers are then transmitted to and stored in the agent database 33 under the control of the data process unit 39. In the case of instant lottery games, winning numbers can be pre-drawn and the serial numbers associated with tickets pre-stored in the agent server. Thus, the instant ticket can be presented to the player immediately upon verification of player information.

Upon receiving the serial numbers associated with the lottery tickets from the state lottery administrator 40, the data process unit 39 confirms the purchases of the lottery tickets and generates control signals to the game server 37 for playing lottery games. In response to the control signals from the data process unit 39, the game server 37 provides the player terminal 10 with image data in the form of the lottery tickets purchased. The player terminal 10 displays on its screen virtual lottery tickets corresponding to the image data of the lottery tickets purchased. The image data may include ticket numbers selected by the lottery player and the serial numbers associated with the lottery tickets. The game server 37 may previously store image data of various types of lottery tickets. The lottery player can then play lottery games with the virtual lottery tickets displayed on the player terminal 10. That is, the lottery player observes a drawing of winning numbers and matches between the winning numbers and the ticket numbers of the virtual lottery tickets. The lottery player can also interactively communicate with the agent server 30 via the Internet 20 while playing lottery games.

The players can also select subscription play from the types of games made available to players from agent server 30. A player selects from the website operated by the agent server 30 the subscription play icon. A subscription form appears to prompt the player to enter subscription play information such as the number of plays, the actual numbers to be played, and the amount of wager per play, etc. The subscription information received by agent server 30 is stored in database 33. A subscription play unit (not shown) in game server 37 monitors the subscription play data stored in database 33. For example, if the number of plays entered by the subscriber player is weekly play, the subscription play unit, in connection with data process unit 39 and agent database 33, will put in play the actual numbers selected by the player (stored in database 33) each week. The subscription play unit also monitors the specific number of plays by counting down by one each time the lottery numbers are played until the specified number of play becomes zero. The subscription play unit preferably generates a 'subscription play complete' flag and the player is notified of the completion of subscription play by agent server 30. Preferably, the flag is generated prior to or at the expiration of the number of plays or the specified time period and the subscriber player is notified prior to or at the end of subscription play. The notification can be sent by email or sent to the account of the player which the player can access over the global electronic network.

After winning numbers are drawn from each game, the state lottery administrator 40 provides the winning numbers to the agent server 30 or the winning numbers are entered into the agent server 30 after they are publicly announced. The verification unit 35 receives the winning numbers and determines if there are any winning lottery tickets of which ticket numbers match the winning numbers. For the determination, the verification unit 35 accesses the ticket information stored in the agent database 33 which includes the ticket numbers of the lottery tickets purchased. The verification unit 35 then compares the respective ticket numbers with the winning numbers to determine the winning lottery tickets.

Upon determining the winning lottery tickets, the verification unit 35 verifies the winning lottery tickets with the serial numbers previously issued by the state lottery administrator 40. For the verification, the verification unit 35 accesses the serial numbers stored in the agent database 33. Since each of the serial numbers is previously issued in association with each of the purchased lottery tickets and stored in the agent database 33, each of the winning lottery tickets can be verified by confirming the serial numbers of the winning lottery tickets with the corresponding serial numbers retrieved from the agent database 33.

Upon being successfully verified with the corresponding serial numbers, information of the winning lottery tickets including the serial numbers are transmitted from the agent database 33 to the state lottery administrator 40 under control of the data process unit 39. Upon receiving the information and the serial number of the winning tickets, the state lottery administrator 40 issues claim validation numbers associated with the winning tickets. Each of the claim validation numbers is unique to each of the winning tickets. The issued claim validation numbers are stored in the state database 42.

The claim validation numbers are transmitted from the state lottery administrator 40 and stored in the agent database 33 under control of the data process unit 39. The agent server 30 also provides the claim validation numbers to the player terminals 10 of the winning players. Upon receiving the claim validation numbers, the winning players are qualified to claim predetermined lottery awards. That is, the winning players can print a claim form including the claim validation numbers at the player terminals 10, and then claim the predetermined lottery awards by completing and submitting the claim form to the state lottery administrator 40. Upon receiving the claim form with the claim validation numbers, the state lottery administrator 40 accesses the corresponding claim validation numbers previously stored in the state database 42 to verify the claim form and the claim validation numbers received. After successful verification of the claim form and the claim validation numbers, the state lottery administrator 40 allows the banking server 50 to reward the predetermined lottery awards under control of the data process unit 39 to the claimants, i.e., the winning players.

The lottery agent system of the present invention further includes the banking server 50 for crediting and debiting the accounts of the lottery players. The accounts for the use of playing lottery games may be credit card accounts or bank accounts of the lottery players, or separate accounts previously established for the lottery players. Such accounts may be stored in the database 51 of the banking server 50. The player can also purchase prepaid cards, which are similar to prepaid phone cards wherein the cards bear a credit or sum of money to be subtracted down each time a player purchases a ticket. The prepaid cards can be in different denominations purchased at convenience stores by cash or check or online with a credit card. The prepaid card preferably bears a user-id number which the player can enter for identification and proper debiting/crediting by the agent server. The banking server 50 credits the accounts of the respective lottery players who own the winning tickets and claim predetermined lottery awards, and debits the accounts of the respective lottery players for the purchases of the lottery tickets. At the time of every credit or debit, the banking server 50 updates the corresponding accounts in the banking database 51. The banking server 50 may directly communicate with credit card providers 53 of the lottery players. That is, the banking server 50 debits and credits credit card accounts of the lottery players upon purchases of the lottery tickets or wins from the lottery tickets purchased.

Figure 2A:
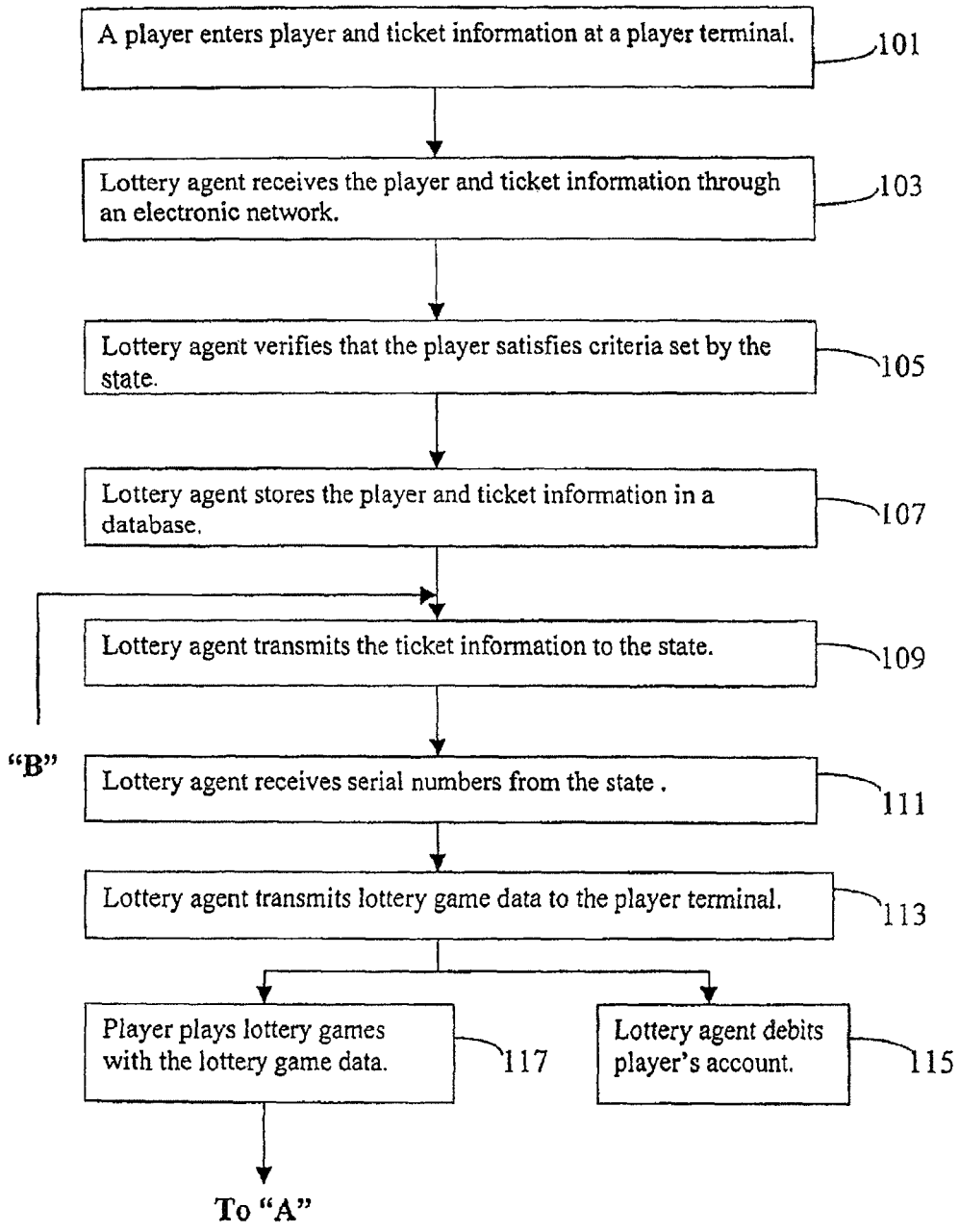
FIGS. 2A and 2B are flow charts describing a method for operating on-line state lottery games according to the present invention.
Figure 2B:
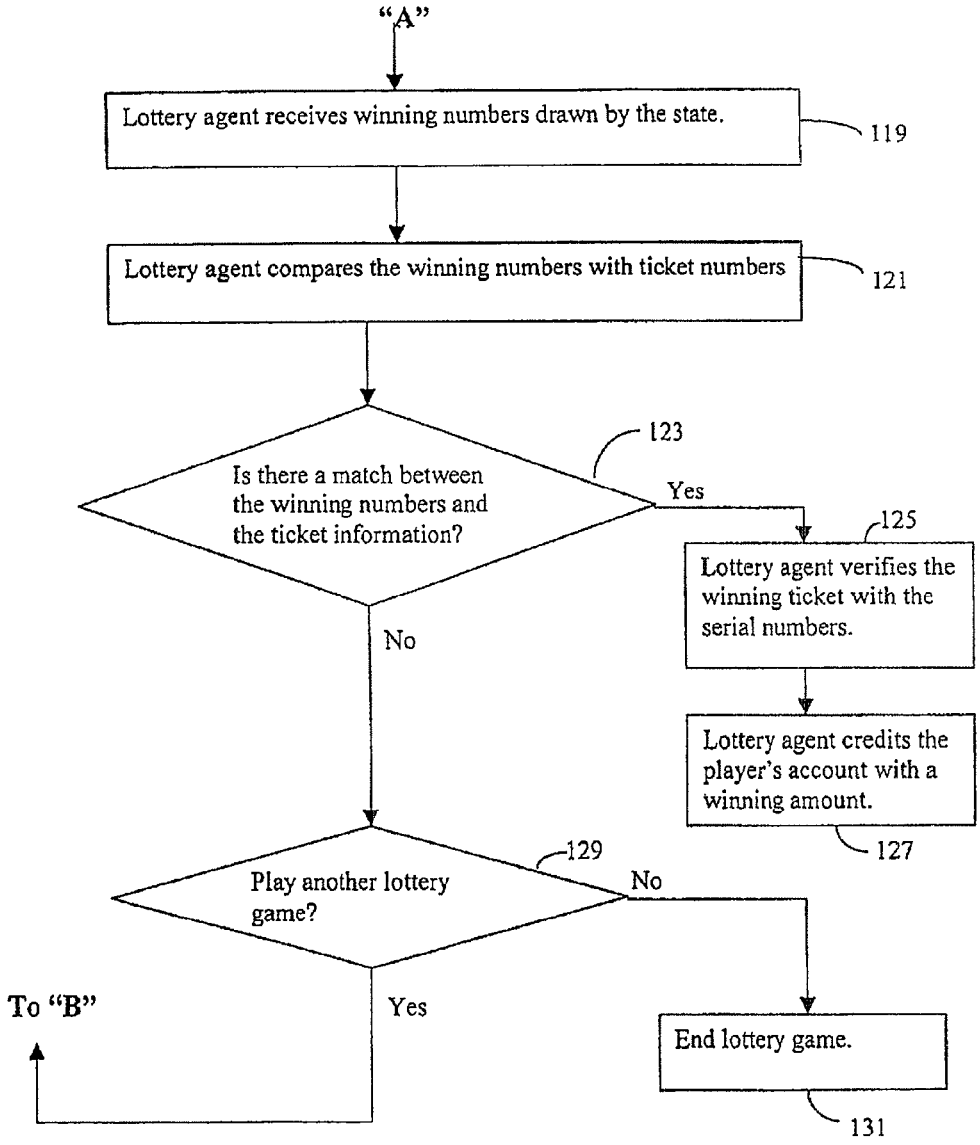

Referring to FIGS. 2A and 2B, a flowchart illustrates a method for facilitating play of on-line state lottery games. To purchase lottery tickets, a lottery player enters his/her player information and ticket information at a player terminal (step 101). The player information may include name, age, address, and account information of the lottery player. The ticket information includes types and numbers of the lottery tickets to be purchased by the lottery player. A lottery agent receives the player and ticket information through an electronic network, such as the Internet (step 103), and verifies that the lottery player satisfies certain criteria required by the state to purchase the state lottery tickets (step 105). For example, the state may require in the criteria that a lottery player must be at least 18 years old and resident in the state.

The lottery agent stores the player and ticket information of the verified player in a database (step 107), and transmits the ticket information to the state, i.e., a state lottery administrator (step 109). The state lottery administrator then issues serial numbers associated with the ticket information after confirming the purchase of the state lottery tickets by the lottery player (step 111). The issued serial numbers, each of which is unique to each of the purchased lottery tickets, are transmitted to the lottery agent. In the case of instant games, the serial numbers can be pre-stored in the database of the agent server for retrieval by the agent server and presented to the player without communication by the agent server to the governmental administrator. After receiving the serial numbers, the lottery agent transmits to the player terminal lottery game data including image data of the lottery tickets (step 113), and at the same time the lottery agent debits the player's account for the purchase of the lottery tickets (step 115) with the lottery game data, the player terminal displays virtual lottery tickets corresponding to the lottery tickets purchased including ticket numbers selected by the player and associated with the serial numbers. The player then plays a lottery game with the virtual lottery tickets displayed on the player terminal (step 117).

After winning numbers are drawn by the state and transmitted to the lottery agent (step 119), the lottery agent compares the winning numbers with the ticket numbers selected by the lottery player (step 121). If there is any match between the winning numbers and the ticket numbers (step 123), the lottery agent verifies the winning ticket with the serial numbers received from the state lottery administrator (step 125). With respect to the verified winning ticket, the lottery agent credits the player's account with a winning amount provided by the state lottery administrator (step 127). If there is no match between the winning numbers and the ticket numbers in the step 123, the lottery agent asks the lottery player whether to play another lottery game (step 129). If the lottery player chooses not to continue the lottery game, the lottery agent ends the player's lottery game (step 131). If the lottery player chooses to play another lottery game, the lottery agent again transmits the ticket information to the state lottery administrator (step 109). Then, the state lottery administrator issues new serial numbers associated with new lottery tickets and provides the new serial numbers to the lottery agent (step 111). Upon receiving the new serial numbers, the lottery agent repeats the steps 113 to 131 as described above.

Figure 3:
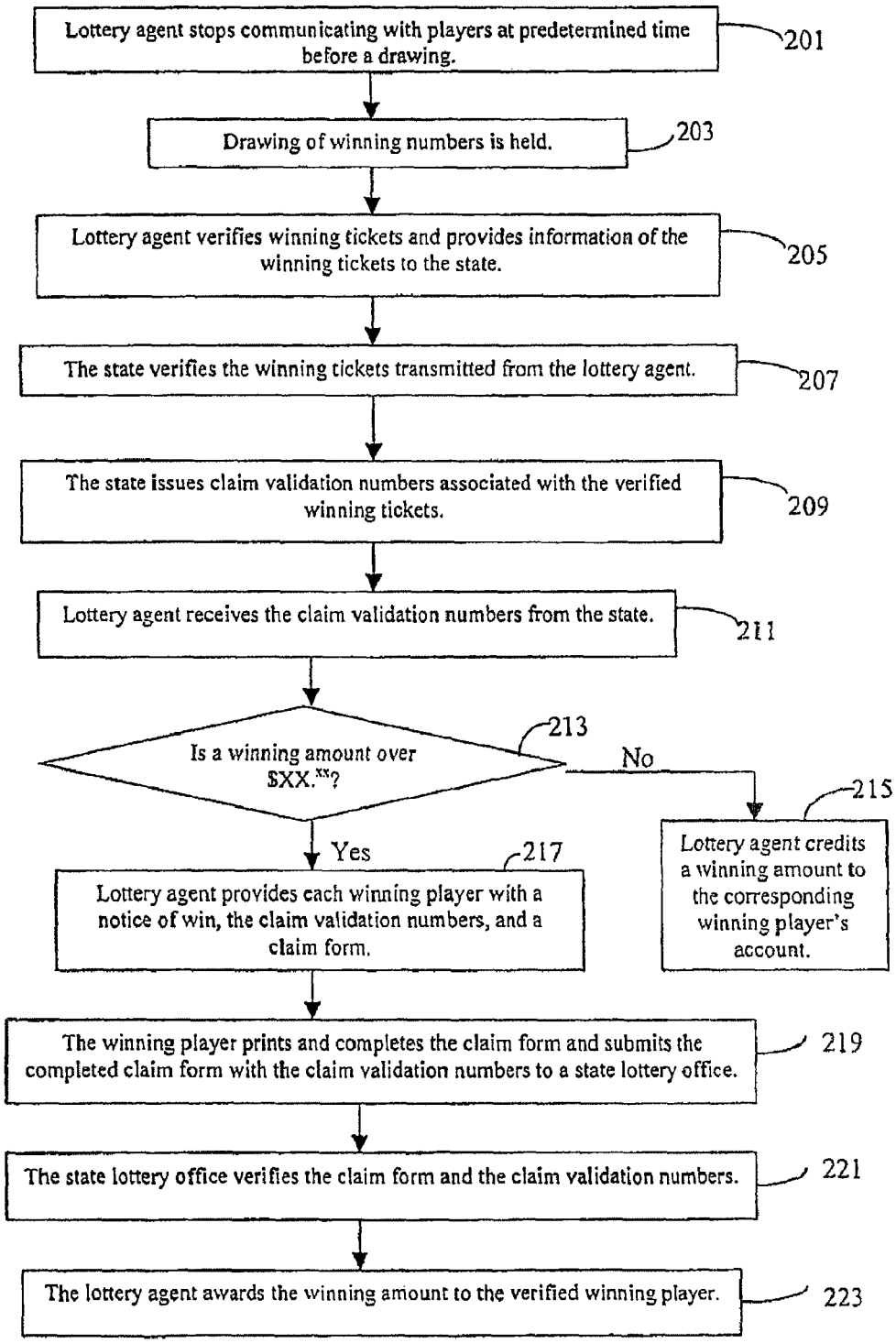
FIG. 3 is a flow chart describing a series of steps for claiming awards for winning lottery tickets.

Referring to FIG. 3, a flow chart illustrates a series of steps for claiming awards for wins in playing lottery games. At a predetermined time before a drawing of winning numbers, a lottery agent managing the lottery games stops communicating with lottery players (step 201). Thus, the lottery players cannot purchase lottery tickets after a predetermined time before a drawing of the winning numbers. After the winning numbers are drawn so that winning tickets are determined (step 203), the lottery agent verifies the winning tickets with the ticket information previously provided by the lottery player and provides the information of the winning tickets to the state (step 205). The verification of the winning tickets includes confirming the winning tickets with serial numbers previously issued by the state in association with the respective winning tickets.

Upon receiving the information of the winning tickets, the state verifies the winning tickets with the ticket information previously stored in a database of the state (step 207). The state then issues claim validation numbers each of which is associated with each of the verified winning tickets (step 209). The claim validation numbers are stored in the state and transmitted to the lottery agent (step 211).

Upon receiving the claim validation numbers associated with the winning tickets, the lottery agent determines whether a winning amount of each winning ticket is over a certain amount of money (step 213). If the winning amount is not over a certain amount of money, the lottery agent credits the winning amount to an account of the corresponding winning player (step 215). If the winning amount is over a certain amount of money, the lottery agent provides each winning player with a notice of win, the claim validation numbers, and a claim form, preferably, via the Internet (step 217). The winning player then prints and completes the claim form and submits the completed claim form with the claim validation numbers to a state lottery office administering the state lottery games (step 219). The state lottery office verifies the claim validation numbers submitted by the winning player with the corresponding claim validation numbers previously stored in the state (step 221). Upon verifying the claim validation numbers, the state allows the lottery agent to award the winning amount to the winning player (step 223).

An exemplary embodiment of the present invention provides a screening unit and method of geographic location verification. The use of the screening unit and method is not limited to lottery play and may be employed for any activity where verifying the geographic location of a participant of an electronic network activity is desired.

Figure 4:
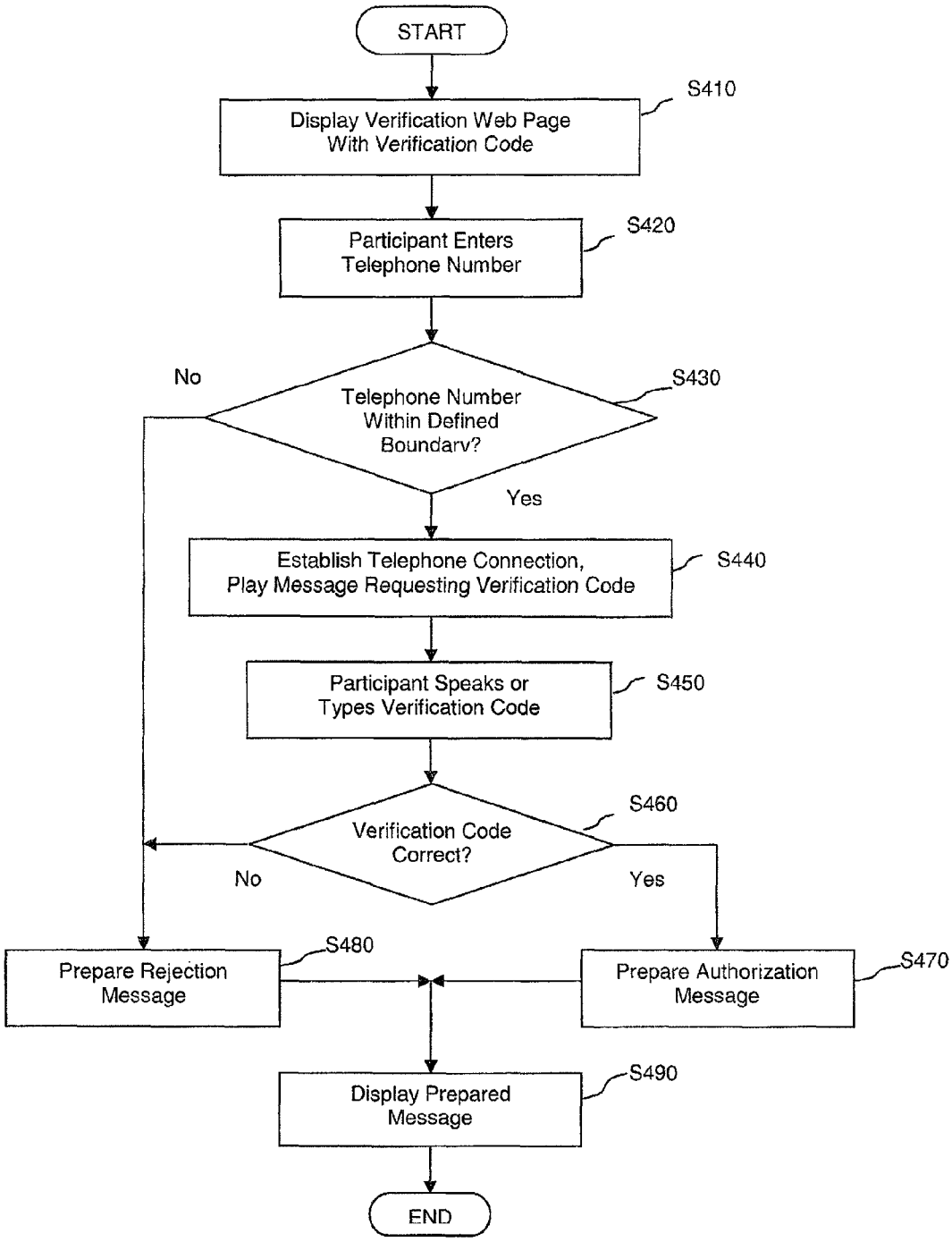
FIG. 4 is a flow chart describing a series of steps for verifying a geographic location according to an exemplary embodiment of the present invention.

FIG. 4 is a flow chart describing a series of steps for verifying a geographic location according to an exemplary embodiment of the present invention. The geographic location verification screening unit and method may utilize a verification link displayed on the web site of the governmental agency, such as where lottery tickets are purchased. Upon activating the verification link, a verification web page is displayed (step 410) and the participating player is prompted to enter a telephone number within the government defined geographic boundary, such as state, where the participating player can presently be reached. The system will also provide the participating player with a verification code, such as a random number code (RNC). The participating player then enters a telephone number of a telephone positioned in close proximity to the participating player (step 420) into an appropriate field on the verification web page. The screening unit or other government agent receives the entered telephone number and verifies (step 430) that the telephone exchange information, such as the area code, is in a valid government defined boundary, e.g., state. If the telephone exchange information is not in a valid government defined boundary, a rejection message is communicated to the participating player (step 480). If the telephone exchange information is in a valid government defined boundary, the screening unit calls the entered telephone number (step 440). When the participating player answers, the screening unit plays a message (step 440) prompting the participating player to speak or enter the provided verification code, e.g., RNC, (step 450). The screening unit verifies that the entered verification code is correct (step 460). The screening unit can determine whether the participating player is located in close proximity to a telephone within the government defined boundary, e.g., state, at that time, since the participating player is limited in time to respond. If the participating player provided the correct verification code, an authorization message is communicated to the participating player (step 470), otherwise a rejection message is communicated to the participating player (step 480). The authorization or rejection is then displayed on a web page (step 490) for the participating player to view. Based on that authorization, the system will allow the electronic network activity, e.g., lottery ticket sale, to proceed.

The verification code may be the previously described RNC or the agency may instruct the participating player to provide any other data on file for identification, such as an account number, a portion of a government issued identification number, or a credit card number.

FIG. 5 illustrates a geographic location verification web page according to an exemplary embodiment of the present invention. Referring to FIG. 5, instructions may be provided to the participating player to follow to perform the geographic location verification procedure on a verification web page. A field is displayed for the participating player to enter a telephone number of a telephone positioned in close proximity to the participating player and a verification code is displayed for the participating player to communicate to further verify that the telephone call is in response to the verification procedure.

Once the telephone verification is complete, the lottery system has determined that the person transacting business on this account is located in close proximity to a telephone in the proper geographic region including the proper state.

Exemplary embodiments of the present invention may also utilize one or more mobile positioning techniques for determining the geographic location of the lottery player and using this location information to verify that the lottery player satisfies criteria concerning the present location of the lottery player. Such techniques may be particularly useful when the lottery player is using a mobile player terminal such as a laptop computer, cellular telephone, smartphone, PDA or other portable computer device. However, these techniques may also be used from a stationary player terminal such as a desktop computer with a wired Internet connection.

According to these techniques, the lottery player's location information may be acquired by positioning hardware and/or software located within the mobile terminal and/or at a base station. Location information may be acquired by global positioning system (GPS), cellular telephone localization, and/or WiFi localization. Where location information is acquired at the mobile terminal, the location information may be securely transmitted to the screening unit, for example, the location information may be transmitted in an encrypted form and/or with a digital signature. Secure transmission may be used to prevent a lottery player from tampering with the player terminal software application installed on the player's mobile device and spoofing false location information. For example, the player's username may be encrypted and watermarked into the location information so that the location information may be accurately associated with the particular user.

As described above, the player's location may be ascertained by employing one or more of the following localization techniques: GPS, cellular telephone localization and WiFi localization. GPS localization and WiFi localization may be performed at the mobile terminal while cellular telephone localization may be performed either at the mobile terminal or at the mobile base station. The mobile terminal software may select one or more of these approaches depending on the capabilities of the player terminal being used. For example, if the player terminal is equipped with a GPS device, localization may be performed using the GPS device. If the player terminal is equipped with a WiFi adapter, WiFi localization may be performed. Modern cellular telephones sold in the United States are equipped with a localization-based system (LBS) for determining the approximate location of the cellular telephone subscriber, and thus this technology may be employed for the purposes of determining the player's location.

GPS localization is the process of monitoring signals sent from a constellation of satellites in orbit around the earth. By triangulating the received satellite signals, the precise location of the player's terminal may be identified. GPS localization may be performed by a GPS receiver that may be integrated into the player's mobile terminal or stationary terminal or attached thereto as a peripheral. In addition to or as an alternative to GPS localization, other satellite localization systems may be used, for example, GLONASS (Russia), Galileo (Europe), COMPASS (China), and IRNSS (India). Although the GPS system technically refers to the NAVSTAR GPS developed by the United States Department of Defense, as used herein, the term GPS may refer to any satellite-based positioning system such as those listed above.

Cellular telephone localization is the process of triangulating the location of the player terminal based on the distance between the mobile terminal and a plurality of cellular towers. Distance may be calculated based on signal strength, signal travel time, and/or the angle of signal arrival. Triangulation may be performed by the mobile terminal by analyzing the travel distance of signals received from a plurality of towers (handset-based localization) or triangulation may be performed by the base station by analyzing the travel distance of signals received from the mobile terminal at a plurality of towers (network-based localization). Thus cellular localization may be performed at the server side or client side.

Examples of cellular telephone localization systems are as follows: cell identification, enhanced cell identification, Time Difference of Arrival (TDOA), Time of Arrival (TOA), Angle of Arrival (AOA), E-OTD, and/or assisted GPS (A-GPS).

Similarly, WiFi localization triangulates the position of the mobile terminal by analyzing the travel distance of received WiFi signals from WiFi hot spots with a known fixed location. Proprietary WiFi hotspots may be particularly suited for this purpose as their locations may be easily known by the network proprietor. In some exemplary embodiments of the present invention, WiFi localization may be combined with cellular telephone localization to provide a more robust and accurate localization system.

Figure 6:
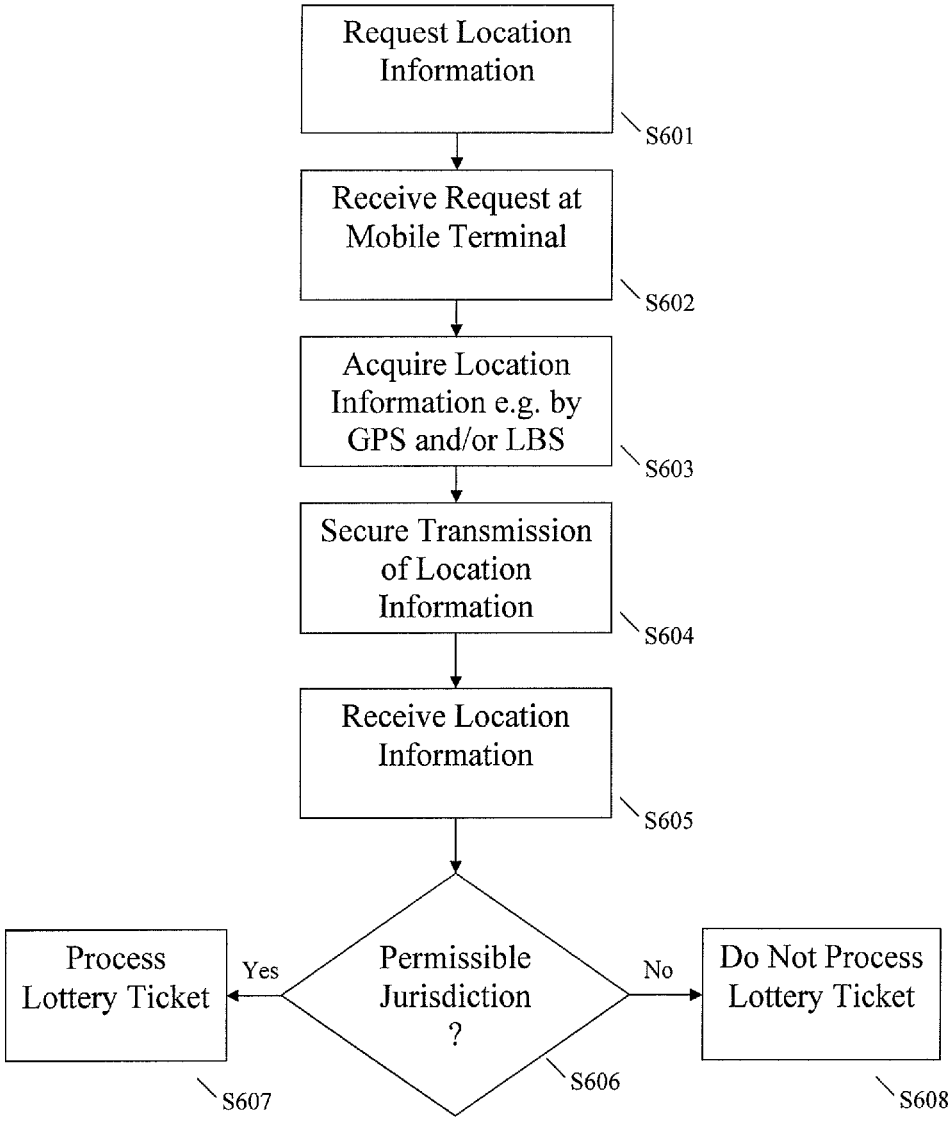
FIG. 6 is a flow chart illustrating a method for a lottery agent verifying the location of a lottery player according to an exemplary embodiment of the present invention.

By using one or more of the above-described localization techniques, the present location of a player using a mobile terminal may be accurately obtained and used to ensure that a player is within the borders of a particular jurisdiction before a lottery ticket transaction is processed. FIG. 6 is a flow chart illustrating a method for a lottery agent verifying the location of a lottery player according to an exemplary embodiment of the present invention. First, the lottery agent may send a request for location information to the mobile player terminal (Step S601). Where the mobile player terminal is connected to the Internet over a wireless network such as a cellular network or a WiFi network, the request may be transmitted over the Internet and the wireless network. The request may then be received by the mobile player terminal (Step S602). The mobile player terminal may then perform localization, using one or more of GPS, cellular localization and WiFi localization to acquire location information (Step S603). The mobile player terminal may then securely send the acquired location information to the lottery agent via the mobile network and the Internet (Step S604). Secure sending may include encrypting, digitally signing and/or watermarking the location information to prevent location spoofing. Where the location information is acquired at the base station, the location information may either be sent directly to the lottery agent or may be sent via the mobile terminal. The lottery agent may then receive the location information (Step S605) and interpret the received location information to determine whether the player's location is within a permissible jurisdiction (Step S606), for example, by analyzing the coordinates of the player's location and comparing it to a map of the permissible jurisdiction. If it is determined that the player's location is within the permissible jurisdiction (Yes, Step S606) then the purchase of the lottery ticket may be performed (Step S607), for example, in accordance with the description provided above. If it is determined that the player's location is not within the permissible jurisdiction (No, Step S606) then the transaction may be prevented (Step S607). These steps may be considered part of the verification step described above with reference to step 105 of FIG. 2A. Thus, the player's location may be accurately gauged prior to sending information to the state and debiting the player's account.

Thus, the system and the method for operating on-line state lottery games according to the present invention provides the lottery players with not only convenient and readily accessible lottery play but also more reliable security on the information for playing the state lottery games. Therefore, the present invention may facilitate lottery games so as to encourage patrons to play lottery games more frequently.

Having described preferred embodiments of a system and a method for playing electronic lottery games according to the present invention, it is noted that modifications and variations can be made by persons skilled in the art in light of the above teachings.

It is also to be understood that the above embodiments are intended to be illustrative, and that any changes may be made in the particular embodiments disclosed, which are within the scope and spirit of the invention as outlined by the appended claims.

What is claimed is:

1. A system for facilitating governmental lottery play over an electronic network, comprising:

an agent server connected via said electronic network configured to receive player and ticket information transmitted from a mobile player terminal, transmit said ticket information to a governmental lottery administrator server distinct from the agent server, receive a serial number generated by said governmental lottery administrator in association with a lottery ticket, and send to the mobile player terminal the serial number associated with the ticket;

a database in said agent server for storing said player and ticket information and said serial number associated with said lottery ticket; and a screening unit in said agent server, having player geographic location criteria by the governmental lottery administrator server pre-stored therein, for verifying that a player satisfies said geographic location criteria prior to transmitting said ticket information to said governmental lottery administrator server, wherein said screening unit:

receives location information based upon distances between the mobile player terminal and a plurality of transmitters with known locations; and determines whether the mobile player terminal satisfies said geographic location criteria based on the transmitted location information.

2. The system of claim 1, wherein the mobile player terminal includes a cellular telephone with a wireless connection to the Internet.

3. The system of claim 2, wherein the cellular telephone is a smartphone.

4. The system of claim 1, wherein the mobile player terminal includes a portable computer with a wireless connection to the Internet.

5. The system of claim 4, wherein wireless connection to the Internet includes a cellular telephone network radio, a WiFi adapter, or a WiMax adapter.

6. The system of claim 1, wherein location information is acquired using GPS.

7. The system of claim 1, wherein location information is acquired using cellular telephone localization.

* * * * *